United States Patent [19]

Cashman

[11] 4,124,847

[45] Nov. 7, 1978

[54] DOOR ALARM SYSTEM

[76] Inventor: Richard D. Cashman, Box 531, Caldwell, Id. 83605

[21] Appl. No.: 789,146

[22] Filed: Apr. 20, 1977

[51] Int. Cl.[2] ..... G08B 13/08

[52] U.S. Cl. ..... 340/545; 200/61.93; 200/61.77

[58] Field of Search ..... 340/274 R; 200/61.93, 200/61.77, 61.62

[56] References Cited

U.S. PATENT DOCUMENTS

| | | | |
|---|---|---|---|
| 3,585,625 | 6/1971 | Prinsky et al. | 340/274 R |
| 4,035,791 | 7/1977 | Katayama | 340/274 R |
| 4,060,704 | 11/1977 | Cole | 200/61.93 |

*Primary Examiner*—Glen R. Swann III

*Attorney, Agent, or Firm*—Daniel J. Tick

[57] ABSTRACT

A door switch is mounted on a door and has a switch arm coupled to the door frame. The door switch is open when the door is closed and is moved to closed position when the door is opened at least approximately 35°. Electrical conductors electrically connect an alarm, an ON-OFF switch and the door switch in circuit to a source of electrical energy whereby when the ON-OFF switch is closed and the door is opened beyond approximately 35°, the alarm is actuated.

2 Claims, 7 Drawing Figures

FIG. 7
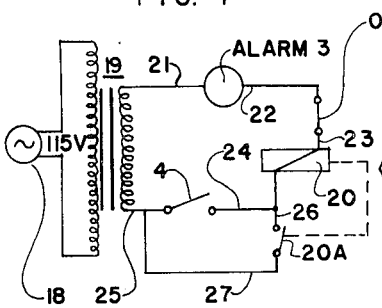
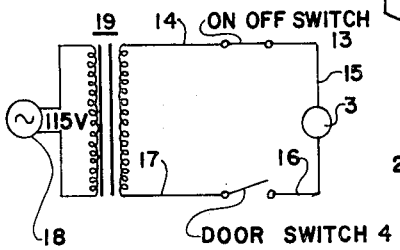
FIG. 6
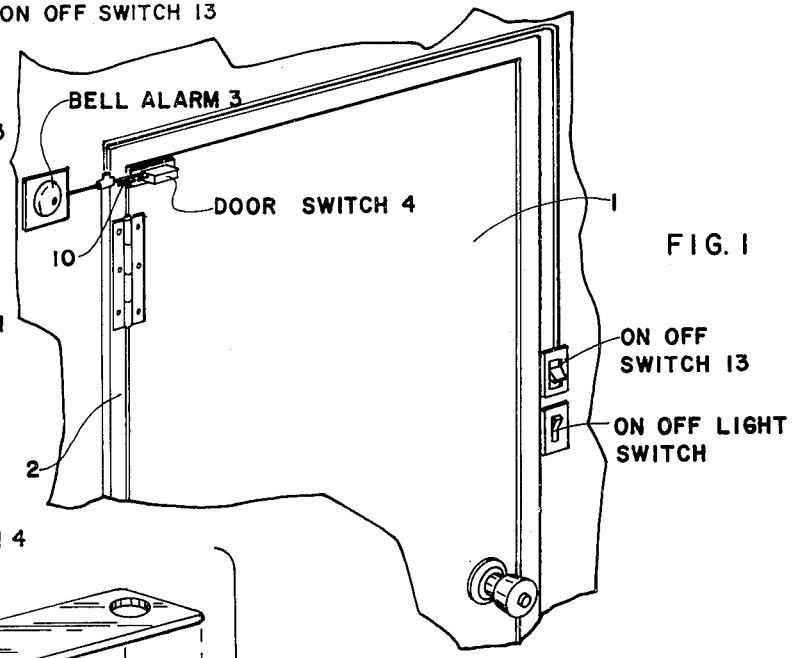
FIG. 1
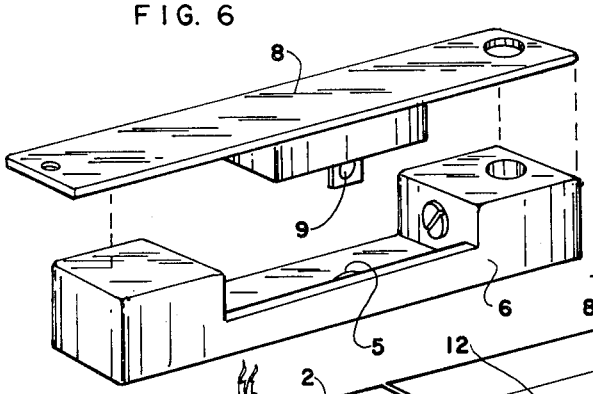
FIG. 5
DOOR SWITCH 4
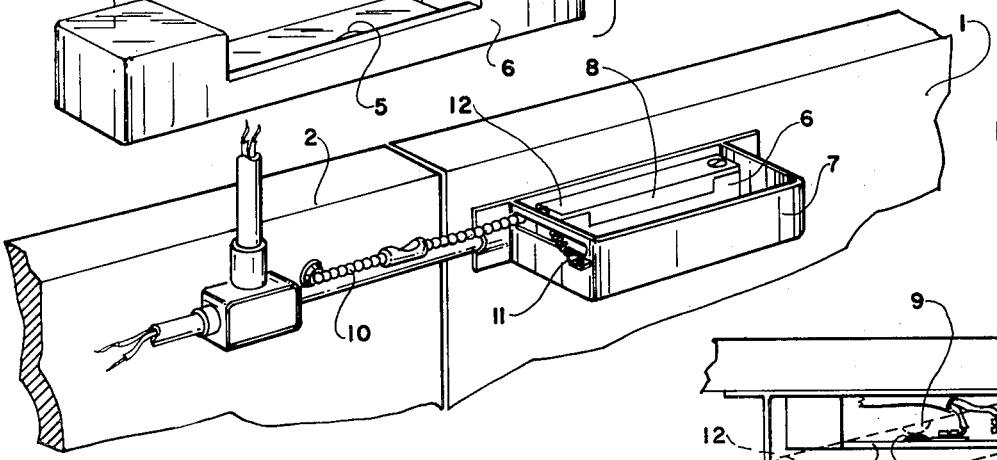
FIG. 2
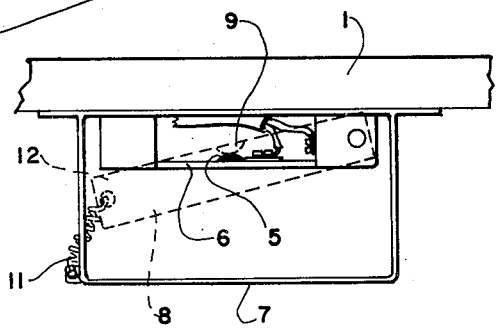
DOOR SWITCH 4
FIG. 4
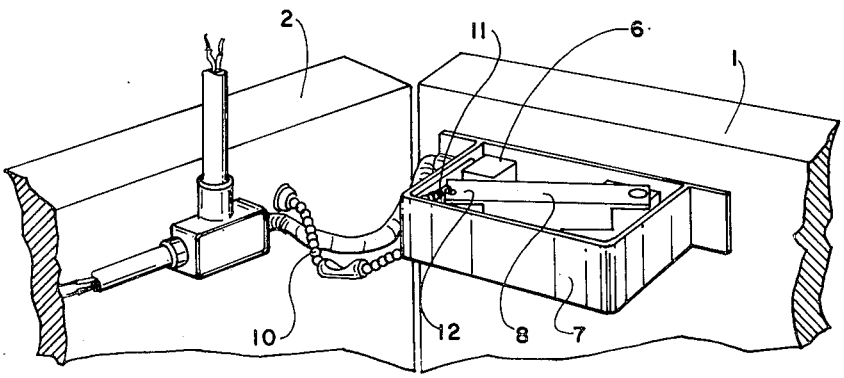
FIG. 3

DOOR ALARM SYSTEM

BACKGROUND OF THE INVENTION

The present invention relates to a door alarm system. More particularly, the invention relates to a door alarm system for a door rotatably mounted in a door frame.

Objects of the invention are to provide a door alarm system for actuating an alarm when a door is opened beyond approximately 35°, which door alarm system is of simple structure, inexpensive in manufacture, installed with facility and convenience, and functions efficiently, effectively and reliably to actuate an alarm when the door is opened beyond approximately 35° and to either deactuate the alarm when closed or maintain the alarm in actuated condition after the door is again closed and until the system is specifically deactuated.

BRIEF DESCRIPTION OF THE DRAWINGS

In order that the invention may be readily carried into effect, it will now be described with reference to the accompanying drawings, wherein:

FIG. 1 is a view of an embodiment of the door alarm system of the invention installed on a door and door frame;

FIG. 2 is a perspective view, on an enlarged scale, of an embodiment of the door switch of the door alarm system of the invention mounted on a door, with the door closed and the switch open;

FIG. 3 is a perspective view, on an enlarged scale, of the embodiment of FIG. 2 of the door switch of the door alarm system of the invention, with the door open and the switch closed;

FIG. 4 is a top plan view, on an enlarged scale, of the embodiment of the door switch of FIGS. 2 and 3, illustrating the operation of such switch;

FIG. 5 is a perspective exploded view, on an enlarged scale, of the embodiment of the door switch of FIGS. 2 to 4;

FIG. 6 is a circuit diagram of an embodiment of the door alarm system of the invention, in which the alarm is deactuated upon the closing of the door; and FIG. 7 is a circuit diagram of another embodiment of the door alarm system of the invention, in which the alarm remains actuated after the door is closed, after initial actuation of the alarm.

DETAILED DESCRIPTION OF THE INVENTION

The door alarm system of the invention is for a door 1 (FIGS. 1 to 4) rotatably mounted in a door frame 2 (FIGS. 1 to 3).

The door alarm system of the invention comprises an alarm 3 (FIGS. 1, 6 and 7) of any suitable type, which alarm may be audible, visible, or a combination of both.

A door switch 4 (FIGS. 1 to 7) is mounted on the door 1 and has a switch arm coupled to the door frame. The door switch 4 is open when the door 1 is closed and is moved to closed position when the door is opened at least approximately 35°.

The door switch 4 comprises an electric conductor 5 stationarily affixed to the door 1 via a support 6 in a housing 7 (FIGS. 4 and 5). A switch arm 8 is pivotally mounted on the support 6 on the door in the housing 7, as shown in FIGS. 2 to 5. The switch arm 8 has an electric conductor 9 (FIGS. 4 and 5) which is maintained in spaced relation with the conductor 5 of the support 6, so that it is maintained out of electrical contact with the conductor 5, when the switch arm is in its position shown in FIGS. 2 and 5. The electric contact 9 of the switch arm 8 is moved into electrical contact with the contact 5, thereby closing an electrical circuit between them, when said switch arm is in its position shown in FIG. 3 and by broken lines in FIG. 4. In the non-contacting position, the switch arm 8 is substantially parallel to the surface of the door 1, whereas in the contacting position, said switch arm is at an angle with said surface of said door.

A mechanical linkage 10 of any suitable type such as, for example, a bead chain, extends from the switch arm 8 to the door frame 2, as shown in FIGS. 1 to 3, and couples the switch arm to the door frame in a manner whereby when the door is closed, the switch arm is out of electrical contact with the electric conductor 5 and when the door is opened beyond approximately 35°, the linkage causes the switch arm to move into electrical contact with the electric conductor 5. This is accomplished by a spring 11 (FIGS. 2 to 4) having one end affixed to the free end 12 of the switch arm 8 and its other end affixed to the housing 7 whereby the linkage 10 holds the switch arm in its position parallel to the surface of the door 1, against the action of the spring 11, as long as the door is closed. As soon as the door is opened beyond approximately 35° however, the mechanical linkage 10 loses its tension to the extent that the spring 11 comes into effect and pulls the free end 12 of the switch arm 8 toward the point of the housing 7 at which the spring is anchored, thereby pivoting said switch arm to the extent that the electrical contacts 5 and 9 come into electrical contact with each other.

An ON-OFF switch 13 is provided (FIGS. 1, 6 and 7).

In accordance with the invention, electrical conductors 14, 15, 16, 17 electrically connect the alarm 3, the door switch 4 and the ON-OFF switch 13 in circuit, as shown in FIG. 6, to a source of electrical energy 18 of any suitable type such as, for example, a commercial power source of 115 volts AC. This is preferably accomplished via a transformer 19. Thus, when the ON-OFF switch 13 is closed, and the door 1 is opened beyond approximately 35°, the alarm 3 is actuated. This is due to the fact that when the door is opened beyond approximately 35°, the door switch 4 is closed, as hereinbefore described, so that its electric contacts 5 and 9 are in electrical contact with each other. The closing of the door switch 4 closes the circuit of FIG. 6.

The embodiment of FIG. 7 is utilized when it is desired to maintain the alarm 3 actuated, once it has been actuated by the opening of the door 1 beyond approximately 35°, after the door is closed. This is accomplished by a relay having a relay energizing winding 20 connected in the circuit 21, 22, 23, 24, 25 in a manner whereby when the door 1 is opened beyond approximately 35°, said relay energizing winding is energized. The relay also has a relay switch 20A controlled in operation by the relay energizing winding 20.

As shown in FIG. 7, a relay holding circuit 26, 27, connects the relay energizing winding 20 to the source of electrical energy 18 via the relay switch 20A whereby the relay and the alarm 3 remain actuated after the door is closed, as long as the ON-OFF switch is closed.

In FIG. 7, when the door 1 is opened, the door switch 4 is closed, in the aforedescribed manner, so that its electrical contacts 5 and 9 are in electrical contact with each other, and the circuit 21, 22, 23, 24, 25 is closed, due to the initial closing of the ON-OFF switch 13. The closing of the circuit actuates the alarm 3 and energizes the relay energizing winding 20 from the commercial power source 18 via the transformer 19. When the relay energizing winding 20 is energized, it closes the relay holding circuit 26, 27 by closing the relay switch 20A. Since the relay holding circuit bypasses the door switch 4, this effectively eliminates the door switch from the operation of the system. Thus, when the door 1 is then closed, thereby opening the door switch 4, the alarm and relay energizing circuit remains closed through the relay holding circuit and said alarm remains actuated while the relay energizing winding remains energized to retain the relay holding circuit in closed condition. The alarm 3 will thus continue to be actuated for as long as the ON-OFF switch 13 is closed. When the user then wishes to deactuate the alarm, he or she opens the ON-OFF switch 13 thereby deactuating the alarm 3 and deenergizing the relay energizing winding 20 so that the relay holding circuit 26, 27 is opened due to the opening of the relay switch 20A.

While the invention has been described by means of specific examples and in specific embodiments, I do not wish to be limited thereto, for obvious modifications will occur to those skilled in the art without departing from the spirit and scope of the invention.

I claim:

1. An open door alarm system for a door rotatably mounted in a door frame, said door alarm system comprising an alarm;

a door switch mounted on the door and having a switch arm coupled to the door frame, said door switch being open when the door is closed and being moved to closed position when the door is opened at least approximately 35°, said door switch comprising a housing, an electric conductor stationarily affixed to the door in the housing, said switch arm being pivotally mounted in the housing on the door at one end thereof and having a spaced opposite second end, a spring having one end affixed to the second end of the switch arm and a spaced opposite end affixed to the housing, and a mechanical linkage from the switch arm to the door frame coupling the switch arm to the door frame in a manner whereby when the door is closed said linkage maintains said switch arm out of electrical contact with the electric conductor against the force of said spring and when the door is opened beyond approximately 35° said linkage loses its tension sufficiently to permit said spring to move said switch arm into electrical contact with said electric conductor;

an ON-OFF switch; and electrical conductors electrically connecting the alarm, the door switch and the ON-OFF switch in circuit to a source of electrical energy whereby when the ON-OFF switch is closed and the door is opened beyond approximately 35° the alarm is actuated.

2. An open door alarm system as claimed in claim 1, further comprising a relay having a relay energizing winding connected in the circuit in a manner whereby when the ON-OFF switch is closed and the door is opened beyond approximately 35° the relay energizing winding is energized and having a relay switch controlled in operation by the relay energizing winding, and a relay holding circuit connecting the relay energizing winding to a source of electrical energy via the relay switch whereby the relay and the alarm remain actuated after the door is closed as long as the ON-OFF switch is closed.

* * * * *